US010982436B1

(12) United States Patent
Ross

(10) Patent No.: US 10,982,436 B1
(45) Date of Patent: Apr. 20, 2021

(54) LOG WALL CONSTRUCTION

(71) Applicant: John P. Ross, Neenah, WI (US)

(72) Inventor: John P. Ross, Neenah, WI (US)

( * ) Notice: Subject to any disclaimer, the term of this patent is extended or adjusted under 35 U.S.C. 154(b) by 0 days.

(21) Appl. No.: 16/734,068

(22) Filed: Jan. 3, 2020

(51) Int. Cl.
*E04B 2/70* (2006.01)

(52) U.S. Cl.
CPC ..... *E04B 2/702* (2013.01)

(58) Field of Classification Search
CPC . E04B 2/70; E04B 2/702; E04B 2/703; E04B 2/704; E04B 2/705; E04B 2/04; E04B 2/06; E04B 2/12; E04B 2/708; E04B 2/709; E04B 2/36; E04B 2/50; E04B 2001/3583; E04B 1/10; E04B 2002/0213; E04B 2002/0239; E04B 2002/028; E04B 2002/0282; E04F 13/147; E04F 13/08; E04F 13/0862; E04F 13/0873; E04F 13/0898; E04F 13/165; E04F 13/185
USPC ..... 52/233
See application file for complete search history.

(56) References Cited

U.S. PATENT DOCUMENTS 1,566,228 A * 12/1925 Ryan ..... E04B 2/42 52/286
1,601,106 A * 9/1926 Carver ..... E04B 2/04 52/284
1,887,777 A 11/1932 Morris
1,941,436 A * 12/1933 Haupt ..... E04B 2/04 52/314
2,073,673 A * 3/1937 Blake ..... E04B 2/12 52/408
2,074,813 A * 3/1937 Sill ..... E04B 2/04 52/284
2,112,861 A * 4/1938 O'Hagen ..... E04B 2/702 52/578
2,142,404 A * 1/1939 Mueller ..... E04B 2/04 52/567

(Continued)

FOREIGN PATENT DOCUMENTS

KR 101053198 B1 8/2011
KR 101602764 B1 3/2016
RU 2580670 C1 4/2016

OTHER PUBLICATIONS

Rob Roy, Youtube video at this link: https://www.youtube.com/watch?v=IBekqHymLfo, dated at least as early as Sep. 19, 2019, with relevant screen shots attached as pp. 1-5, and viewed in the United States on the internet.

(Continued)

*Primary Examiner* — Kyle J. Walraed-Sullivan
(74) *Attorney, Agent, or Firm* — Epiphany Law, LLC

(57) ABSTRACT

A log wall construction including a plurality of log blocks, each having a substantially same height-dimension and laid next to each other to form a log block row having a log block row length. Log blocks next to each other have at least one pair of adjacent curved surfaces for each pair of log blocks next to each other. A second log block row of the plurality of log blocks laid next to each other to form the second log block row having a second log block row length and being located on top of the first log block row. A stringer located between the log block row and the second log block row and separating each log block row from each other log block row. The stringer extends substantially an entire distance equivalent to both the log block row length and the second log block row length.

20 Claims, 8 Drawing Sheets

(56) References Cited

U.S. PATENT DOCUMENTS 2,183,620 A * 12/1939 Myers ..... E04B 2/702 52/520
2,192,366 A * 3/1940 Poroma ..... E04B 2/04 52/437
2,320,466 A 6/1943 Presley
2,550,883 A * 5/1951 St Vincent ..... E04B 2/703 52/233
2,826,906 A * 3/1958 Rice ..... E04B 2/16 52/585.1
3,343,328 A * 9/1967 Rolle ..... E04B 2/704 52/605
3,618,279 A * 11/1971 Sease ..... E04B 2/46 52/223.7
3,863,409 A * 2/1975 Fell ..... E04B 2/702 52/233
4,021,983 A 5/1977 Kirk, Jr.
4,047,350 A 9/1977 Chisum
4,823,528 A * 4/1989 Faw ..... E04B 2/702 52/233
4,946,632 A * 8/1990 Pollina ..... E04B 2/20 264/256
4,996,813 A * 3/1991 Kliethermes, Jr. ..... E04C 1/395 52/592.1
5,003,746 A * 4/1991 Wilston ..... A63H 33/042 52/592.1
5,119,587 A * 6/1992 Waltz ..... A01G 9/28 47/33
5,154,032 A * 10/1992 Ritter ..... E04C 1/395 405/284
5,181,362 A * 1/1993 Benitez ..... E04B 2/18 52/578
5,265,390 A * 11/1993 Tanner ..... E04B 2/705 52/233
5,337,527 A * 8/1994 Wagenaar ..... E02D 29/025 405/284
5,421,135 A * 6/1995 Stevens ..... E04B 2/16 405/284
5,537,796 A * 7/1996 Kliethermes, Jr. ... E02D 29/025 52/592.6
5,577,357 A * 11/1996 Civelli ..... E04B 2/702 52/233
5,651,642 A * 7/1997 Kelley, Jr. ..... E02D 29/025 405/284
6,023,895 A * 2/2000 Anderson ..... E04B 2/702 52/233
6,053,661 A * 4/2000 Lewis ..... E02B 11/00 405/258.1
6,363,672 B1 4/2002 Baker
6,385,929 B1 * 5/2002 Englehart ..... F16B 7/18 52/233
6,455,113 B1 * 9/2002 Bilodeau ..... B44C 3/123 362/147
6,907,705 B2 * 6/2005 Dean ..... E04C 1/395 405/284
7,387,472 B2 * 6/2008 Abella ..... E04C 1/395 405/284
7,413,081 B2 * 8/2008 Rogers ..... B65D 1/14 206/504
8,701,364 B2 * 4/2014 Wrightman ..... E04B 2/702 52/233
2002/0026763 A1 * 3/2002 Schmitz ..... E04C 1/395 52/605
2003/0029123 A1 * 2/2003 Pignataro ..... E04C 5/18 52/712
2003/0233799 A1 * 12/2003 Chavez ..... A63H 33/044 52/233
2004/0182029 A1 * 9/2004 Berg ..... E04C 5/203 52/379
2004/0187411 A1 * 9/2004 Clegg ..... E04B 2/702 52/233
2005/0091940 A1 * 5/2005 Whitson ..... E04C 1/395 52/574
2006/0059824 A1 * 3/2006 Barbisch ..... E02D 29/025 52/503
2006/0242914 A1 * 11/2006 Stephansky ..... F27D 1/0006 52/27
2006/0248816 A1 * 11/2006 Williams ..... E04H 4/00 52/169.1
2007/0056235 A1 * 3/2007 Kohler ..... E04C 2/041 52/223.7
2007/0130852 A1 * 6/2007 Sieber ..... E04B 2/702 52/233
2007/0130860 A1 * 6/2007 Paquette ..... E04F 13/0862 52/311.1
2007/0137128 A1 * 6/2007 Viau ..... E04F 13/0803 52/388
2007/0163203 A1 * 7/2007 Price ..... E04F 13/0821 52/834
2007/0251182 A1 * 11/2007 Van Steinburg ..... E04B 2/06 52/586.1
2007/0261365 A1 * 11/2007 Keene ..... E04F 13/04 52/796.1
2008/0298902 A1 * 12/2008 Knudson ..... E02D 29/025 405/286
2009/0133345 A1 * 5/2009 Wrightman ..... E04B 2/702 52/233
2010/0043323 A1 * 2/2010 Wrightman ..... E04C 3/29 52/233
2010/0218447 A1 * 9/2010 Gehring ..... E04F 13/147 52/435
2011/0146171 A1 * 6/2011 Flatland ..... E04C 3/122 52/233
2011/0203197 A1 * 8/2011 Najafi ..... E04B 2/06 52/173.1
2011/0289877 A1 * 12/2011 Correia ..... E04F 13/147 52/309.4
2012/0096793 A1 * 4/2012 Riccobene ..... E01C 9/004 52/311.2
2012/0174511 A1 * 7/2012 Harding ..... E04D 13/076 52/302.1
2013/0008107 A1 * 1/2013 Herman ..... E04B 2/708 52/233
2013/0305646 A1 * 11/2013 Mann ..... E04F 13/0816 52/477
2014/0041331 A1 * 2/2014 Buoni ..... E04F 13/0733 52/506.01
2015/0286752 A1 * 10/2015 Karau ..... G06T 19/20 703/1
2016/0222655 A1 * 8/2016 Lin ..... E04B 2/08
2016/0244936 A1 * 8/2016 MacDonald ..... B28B 7/0097
2020/0011065 A1 * 1/2020 Saniepey ..... B32B 13/14
2020/0024850 A1 * 1/2020 Fox ..... E04F 13/0873
2020/0048906 A1 * 2/2020 Honkala ..... B32B 21/04

OTHER PUBLICATIONS

Goggle Images, file name "Log Home Joinery—Comfort System 5", dated at least as early as Sep. 19, 2019, 1 page, and viewed in the United States on the internet.
Goggle Images, file name "Cordwood Construction dot org", dated at least as early as Sep. 19, 2019, 1 page, and viewed in the United States on the internet.
Goggle Images, file name "Poleshed example", dated at least as early as Sep. 19, 2019, 1 page, and viewed in the United States on the internet.
Goggle Images, file name "Sojourn cabin", dated at least as early as Sep. 19, 2019, 3 pages, and viewed in the United States on the internet.
Google Images, file name "partial building corewood", dated at least as early as Sep. 19, 2019, 1 page, and viewed in the United States on the internet.
Google Images, file name "another example corewood build", dated at least as early as Sep. 19, 2019, 1 page, and viewed in the United States on the internet.
Google Images, file name "still another example corewood build", dated at least as early as Sep. 19, 2019, 1 page, and viewed in the United States on the internet.

(56) References Cited

OTHER PUBLICATIONS

Google Images, file name "motar and insulation fill", dated at least as early as Sep. 19, 2019, 1 page, and viewed in the United States on the internet.

* cited by examiner

LOG WALL CONSTRUCTION

TECHNICAL FIELD

This invention relates to the use of logs to make dwellings and other buildings, and more particularly, is directed to log blocks of uniform thickness which can be laid in courses to easily build a log wall and thereby a dwelling.

BACKGROUND

Log cabins have been known and used as dwellings for hundreds of years. The current methods of building a log cabin include construction of a cabin by hand from logs in their natural shape, and construction of a cabin from interchangeable prefabricated logs produced in a manufacturing environment. In either method, logs are stacked horizontally crosswise to form a multi-walled structure.

The construction of a house or dwelling in the form of a log cabin has notable advantages, particularly in the strength and rigidity of the structure and in the thermal insulation provided by the thick wood logs. However, because of the difficulty of providing full logs, properly fitted so as to seal against the weather and maintenance of the same, the construction of houses by the uses of sawed lumber advanced while the construction of log cabins terminated. However, there are certain advantages in the use of a log cabin for style and comfort, but also in the fact that in many wilderness areas where industry requires the attendance of a number of people, it is difficult to provide the kind of saw mill required to cut logs to the proper lumber size for conventional housing construction.

Another common facet of conventional log building techniques is that the length or width of the home is dependent on the length of the logs. Having long logs has at least two major disadvantages. First, the price for logs exponentially increases in relation to the length needed, drastically driving up the cost of larger houses. Second, portions of many of these long logs are wasted, because most exterior walls are constructed as solid walls, with the logs extending the entire length of the wall. First, the log is cut to the desired length, creating wasted material. Openings for any doors or windows are cut out from the solid wall and the material removed from the openings is discarded. The home owner is paying for log material not utilized in the final house.

Traditional log buildings include full round logs and squared logs several feet in length stacked horizontally. Another method uses short cord wood pieces stacked into a wall made stable by the use of mortar as a construction component. However, the use of full logs is also cumbersome due to their size and weight which requires a crane or lift to work and place the logs. Narrow sections of log walls where two logs meet do not provide significant insulating value and require maintenance of the chinking. Cord wood logs laid with mortar can be very time consuming to construct and over time, unstable. And, because of the significant surface variations, modern interior and exterior finishing materials like siding, drywall, and plywood cannot be used.

The common techniques for log home construction have many non-desirable aspects, concerns, and maintenance problems associated with the dwelling. Accordingly, there is a need for more easily handled building materials which can (i) be laid in courses to build a log wall and dwelling and/or (ii) used with no special equipment or machinery to do the construction. Also, better insulating value than a traditional log wall can provide, is desired. These concerns, those of maintenance problems and high expenses, are drawbacks to any currently available log building.

SUMMARY

The log wall construction of the present invention minimizes, or may eliminate, one or more of the above-discussed concerns and problems. As such, there is provided a log wall construction. The wall construction includes a plurality of log blocks each having a substantially same height-dimension and laid next to each other to form a log block row. Each row has a log block row length. Each log block has a top flat surface, a bottom flat surface, a front flat surface, a back flat surface, a right curved surface and a left curved surface. Log blocks next to each other have at least one pair of adjacent curved surfaces for each pair of log blocks next to each other. The construction also includes a second log block row of the plurality of log blocks each having a second substantially same height-dimension and laid next to each other to form the second log block row. This row has a second log block row length and is located on top of the first log block row. And, the construction further includes a stringer located between the log block row and the second log block row and separating the flat top surface of each log block in the log block row from the flat bottom surface of each log block in the second log block row wherever log blocks of the log block row are adjacent to log blocks of the second log block row. The stringer extends substantially an entire distance that is equivalent to both the log block row length and the second log block row length.

In another aspect of the invention, there is provided a log wall construction. The construction includes a plurality of log blocks each having a substantially same height-dimension and laid next to each other to form a log block row having a log block row length. Each log block has a top flat surface, a bottom flat surface, a front flat surface, a back flat surface, a right curved surface and a left curved surface. Log blocks next to each other have at least one pair of adjacent curved surfaces for each pair of log blocks next to each other. Also includes is a second log block row of the plurality of log blocks each having a second substantially same height-dimension and laid next to each other to form the second log block row having a second log block row length and being located on top of the first log block row. Further, is included a stringer located between the log block row and the second log block row and separating the flat top surface of each log block in the log block row from the flat bottom surface of each log block in the second log block row wherever log blocks of the log block row are adjacent to log blocks of the second log block row. The stringer extends substantially an entire distance that is equivalent to both the log block row length and the second log block row length. The stringer has a front runner with a front stringer edge that is adjacent to the front surface of the log blocks and the stringer has a back runner with a back stringer edge that is adjacent to the back surface of the log blocks. Yet further, at least two log blocks next to each other have at least a portion of each block touching each other at their respective adjacent curved surfaces and each log block row has the same sized log block in that log block row.

Other aspects of the invention are directed to the configuration and features of the log blocks themselves and relative to each other, the configuration and features of the stringer, and the configuration and features of the log block rows.

BRIEF DESCRIPTION OF THE DRAWINGS

The invention may be more completely understood in consideration of the following detailed description of various embodiments of the invention in connection with the accompanying drawings, in which.

Figure 1A:
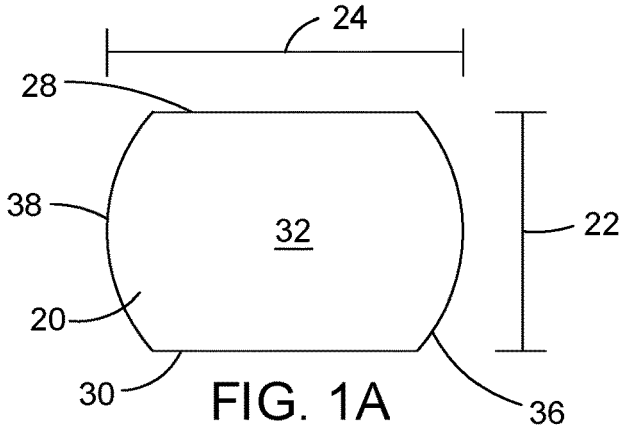
FIG. 1A is a front view of a log block of the invention.

The drawings show some but not all embodiments. The elements depicted in the drawings are illustrative and not necessarily to scale, and the same (or similar) reference numbers denote the same (or similar) features throughout the drawings.

DETAILED DESCRIPTION

In accordance with the practice of at least one embodiment of the invention, as seen in FIGS. 3-6 for example, there is a log wall construction 10. Construction 10 includes a plurality of log blocks 20 (seen in detail in FIGS. 1A, 1B, 2A and 2B) each having a substantially same height-dimension 22 and laid next to each other to form a log block row 50 having a log block row length 52. Each log block 20 has a top flat surface 28, a bottom flat surface 30, a front flat surface 32, a back flat surface 34, a right curved surface 36 and a left curved surface 38. Preferably, flat top and bottom surfaces 28, 30 are substantially parallel to parallel to one another. Log blocks next to each other have at least one pair of adjacent curved surfaces (36, 38) for each pair of log blocks next to each other. Construction 10 further includes a second log block row 60 of the plurality of log blocks 20 each having a second substantially same height-dimension 22 and laid next to each other to form the second log block row having a second log block row length 62 and being located on top of the first log block row 50. Still further, construction 10 includes a stringer 70 located between the log block row 50 and the second log block row 60 and separating the flat top surface 28 of each log block 20 in the log block row 50 from the flat bottom surface 30 of each log block 20 in the second log block row 60 wherever log blocks of the log block row 50 are adjacent to log blocks of the second log block row 60. The stringer extends substantially an entire distance 72 that is equivalent to both the log block row length 52 and the second log block row length 62. The stringer serves to both tie together the log blocks in a row, as well as provide a consistent spacing between log blocks in adjacent rows. Stringer height-dimension may be the same from row to row, or variations between different rows may be used, as desired.

Without being limited to a theory of understanding, surprisingly it was found this new combination of elements including the configuration and shape of the log blocks, especially as compared to full logs used to build dwellings, makes building a log wall possible unlike before. Additionally, the invention enables more easily handling building materials with no special equipment or machinery needed to do the construction. Further the log wall construction can be laid in courses to build a log wall and dwelling. Yet further, the construction 10 enables a better insulating value than a traditional log wall can provide.

Figure 1B:
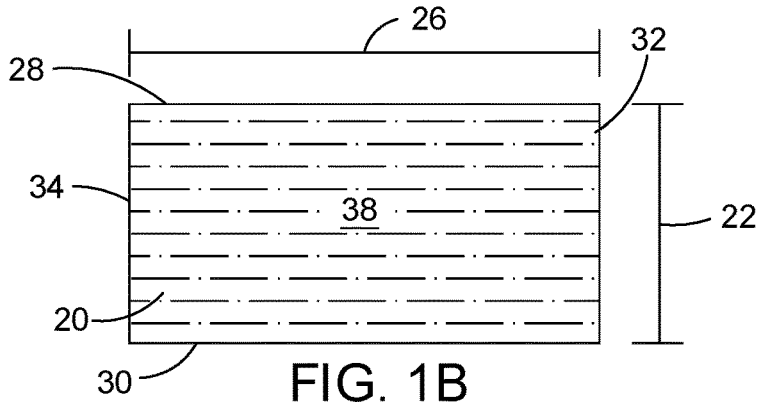
FIG. 1B is a side view of that in FIG. 1A.
Figure 2A:
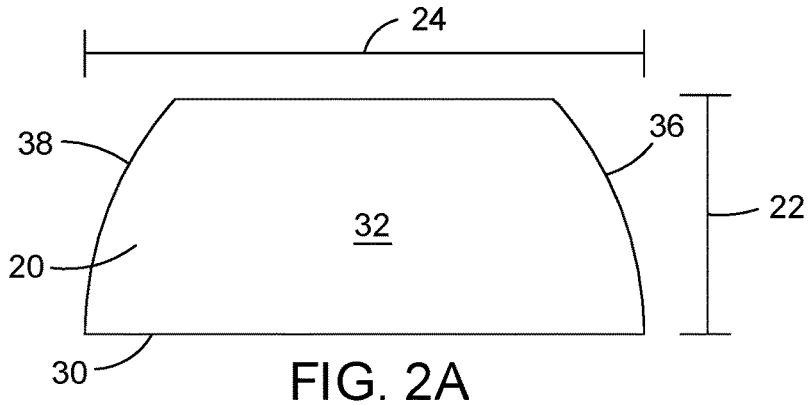
FIG. 2A is a front view of an alternate embodiment of a log block of the invention.
Figure 2B:
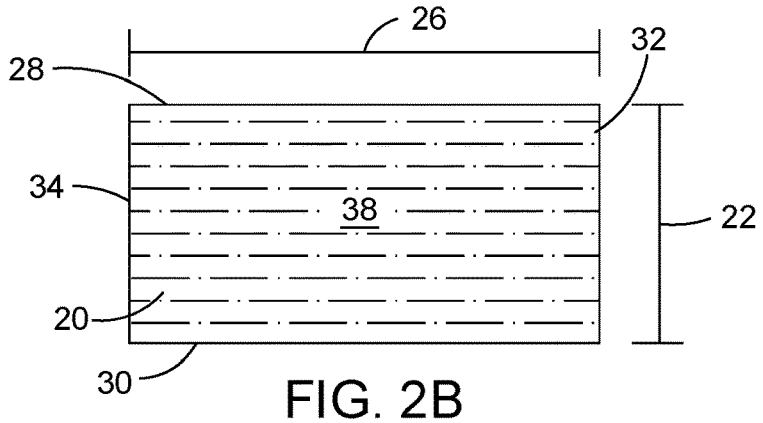
FIG. 2B is a side view of that in FIG. 2A.
Figure 3:
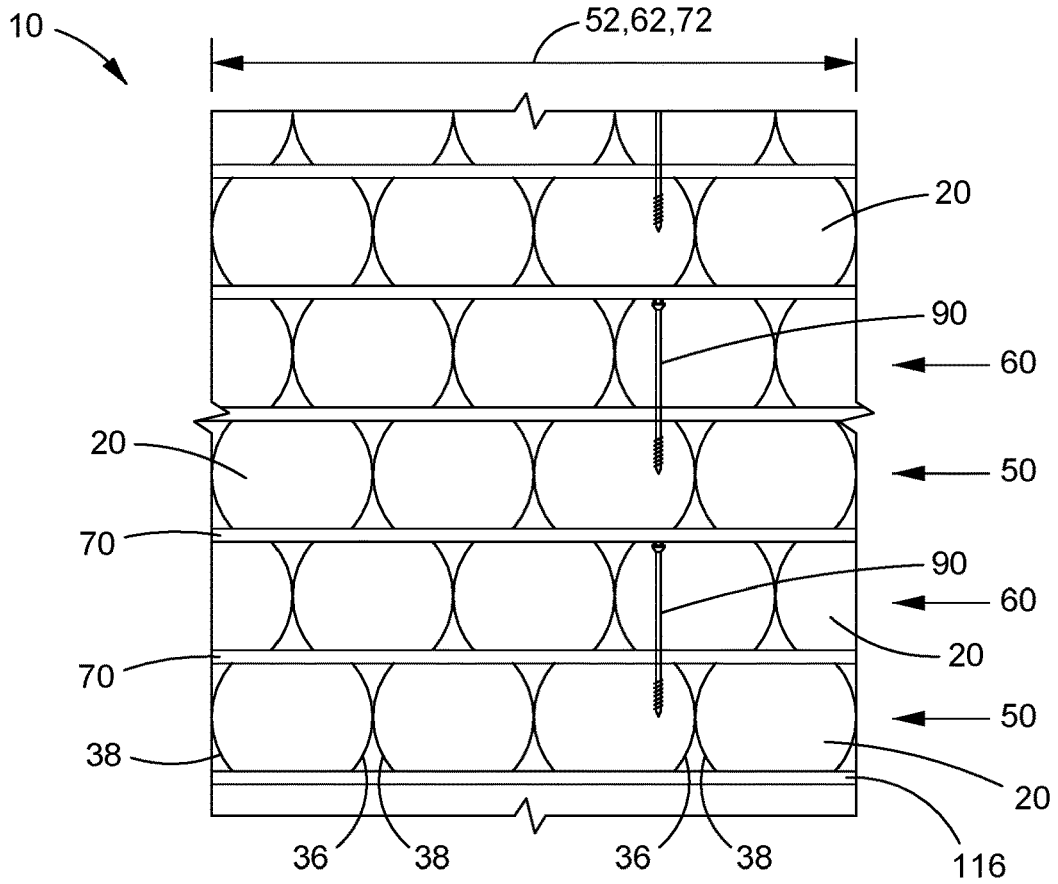
FIG. 3 is a front view of a log wall construction using the log block of FIG. 1A.
Figure 4:
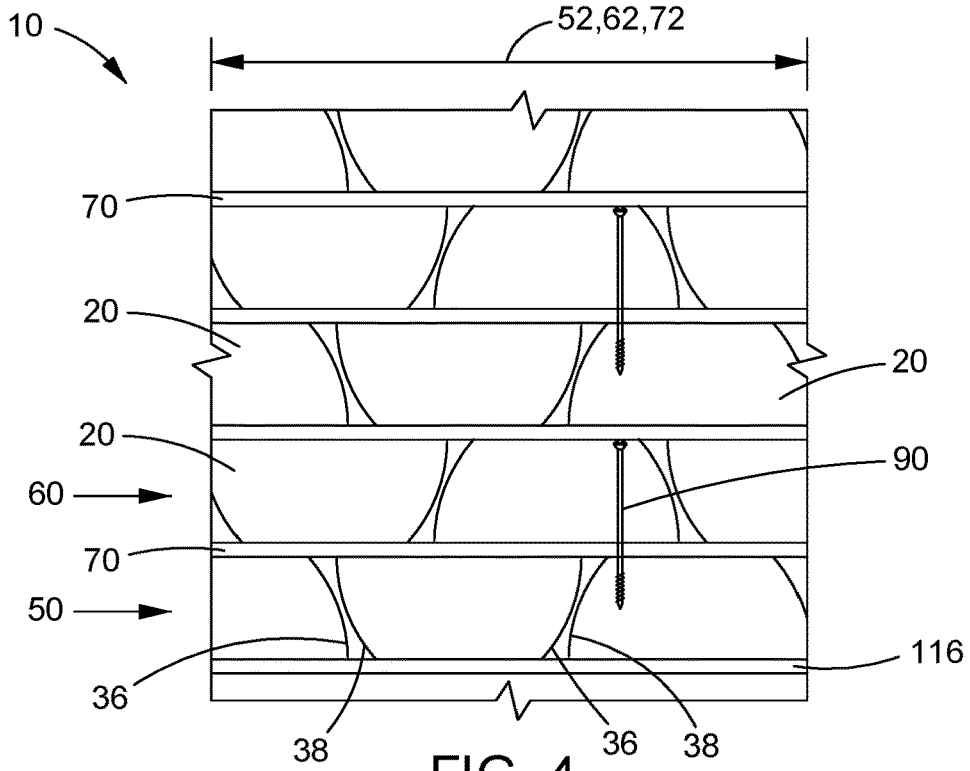
FIG. 4 is a front view of an alternate log wall construction using the log block of FIG. 2A.
Figure 5:
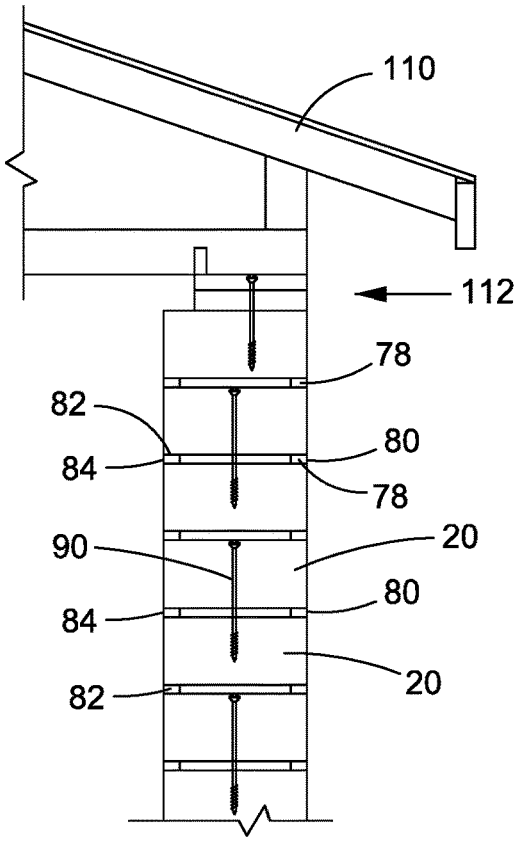
FIG. 5 is a cut-away end view of a log wall construction as a portion of a dwelling.

Other features the invention may include are directed to the log blocks themselves, as seen in detail in FIGS. 1 and 2 collectively. For example, at least some of the log blocks may be full-sized log blocks as seen in FIGS. 1A, 1B, 3, 7-9. Alternately, at least some of the log blocks may be half-sized log blocks as seen in, for example, FIGS. 2A, 2B and 4. For such half-sized log blocks, they may have a width-dimension 24 that is at least two times as long as a height-dimension 22. The primary difference between full-sized log blocks and half-sized log blocks is their height-dimension 22, such that the half-sized log blocks right and left curved surfaces are only about a quarter of the circumference of the log used before it is cut to have flat top and bottom surfaces, or stated in corollary, the right and left curved surfaces are one-half of the log's fully curved side surfaces after the log is cut to have flat top and bottom surfaces but before it is cut in half along its width-dimension 24. Differently, for a full-sized log block it has fully curved right and left curved surfaces after the log is cut to have flat top and bottom surfaces and it has its width-dimension 24. Half-sized log blocks are generally formed from larger diameter logs and made first into full-sized log blocks that are then cut again along their center diameter to form two half-sized log blocks. While various sizes are possible, half-sized log blocks can be, for example, 4 to 10 inches in width-dimension 24, 4 to 8 inches in height-dimension 22, and 6 to 24 inches in length-dimension 26. And, while various sizes are possible, full-sized log blocks can be, for example, 6 to 20 inches in width-dimension 24, 4 to 10 inches in height-dimension 22, and 6 to 24 inches in length-dimension 26.

Another feature is directed to the material used to seal the space between adjacent log blocks. For example, at least two, preferably many, and even more preferably in some embodiments substantially all, log blocks next to each other could have at least a portion of each log block touching each other at their respective adjacent curved surfaces. Alternately or additionally, the seal between the log blocks could be: nothing (other than touching log blocks as shown), spray foam, insulation (e.g., fiberglass) stuffed or blown in, caulk, or other conventional suitable materials as would be known to one of ordinary skill in the art of building construction in conjunction with the teaching here.

In regards to securing one log block row to another log block row, and with reference to FIGS. 3-6 for example, a variety of options exist. Mere gravity may be sufficient. Alternately or additionally, one or more mechanical fastener may secure the log block row to the second log block row, for example, glue or other bonding material joined to each adjacent component of the wall and in particular at least the log blocks to stringers and stringers to log blocks. Alternately or additionally, the mechanical fastener could be like element 90 and extend in and between at least a portion of the log block row and at least a portion of the second log block row, for example, a bolt, lag screw or similar boring and securing device.

Figure 6:
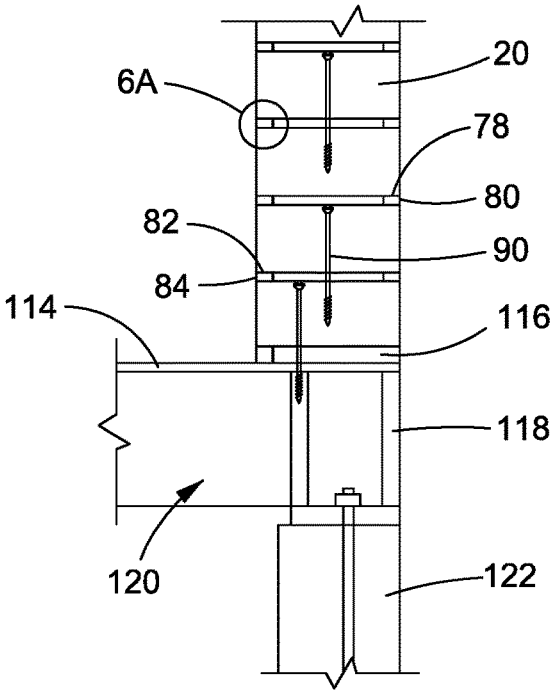
FIG. 6 is a cut-away end view of a log wall construction as a different portion of a dwelling.
Figure 6A:
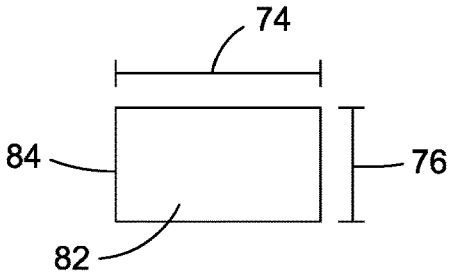
FIG. 6A is an enlarged, focused view of the stringer seen in portion 6A of FIG. 6.

Turning to additional features the stringer may include, reference is made to FIGS. 3-6 and 10-11. The stringer can have, and preferably has, a front runner 78 with a front stringer edge 80 that is adjacent to the front surface 32 of the log blocks. The stringer may also have a back runner 82 with a back stringer edge 84 that is adjacent to the back surface 34 of the log blocks. Further, and more preferably, the front runner is separated from the back runner (as seen in most Figures, except not in FIGS. 10, 11, 14A and 14B which have a more solid stringer structure from front runner to back runner). Still more preferably, the front runner is distinct from and completely separated from the back runner. In other aspects, the stringer can have a width-dimension 74 that is at least two times as long as a height-dimension 76, see FIG. 6A for better clarity. Further, the height-dimension of the stringer may be between about 0.5 inches and about 1.5 inches, and more preferably is between about 0.75 inches and about 1.25 inches, and even more preferably is between about 0.9 inches and about 1.1 inches. Yet further, additionally or alternately, the width-dimension of the stringer may be between about 1 inch and about 3 inches, and more preferably is between about 1.5 inches and about 2.5 inches, and even more preferably is between about 1.75 inches and about 2.25 inches. The stringer may be made of wood, wire, metal sheet, plastic webbing, plastic wood or other conventional suitable materials as would be known to one of ordinary skill in the art of building construction in conjunction with the teaching here.

Figure 7:
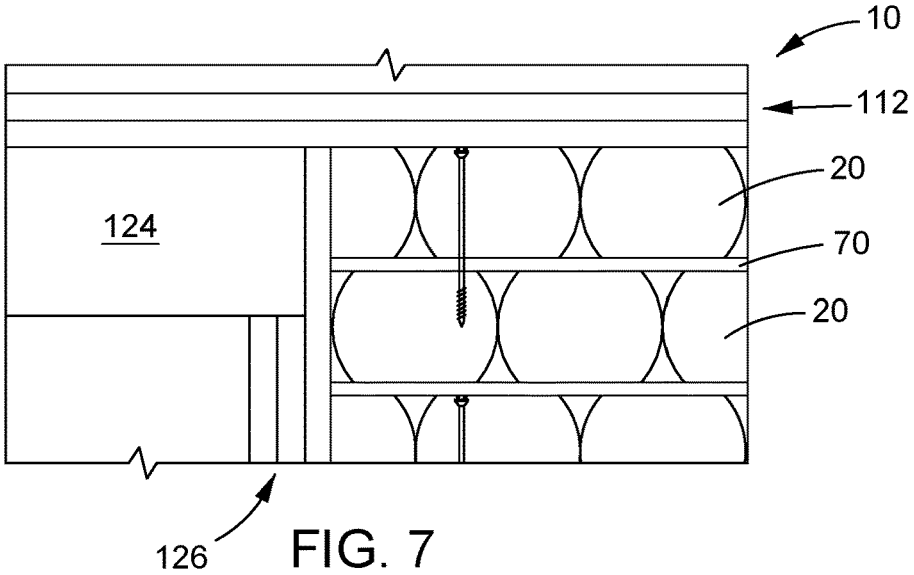
FIG. 7 is a front view of a log wall construction as a door portion of a dwelling.
Figure 8:
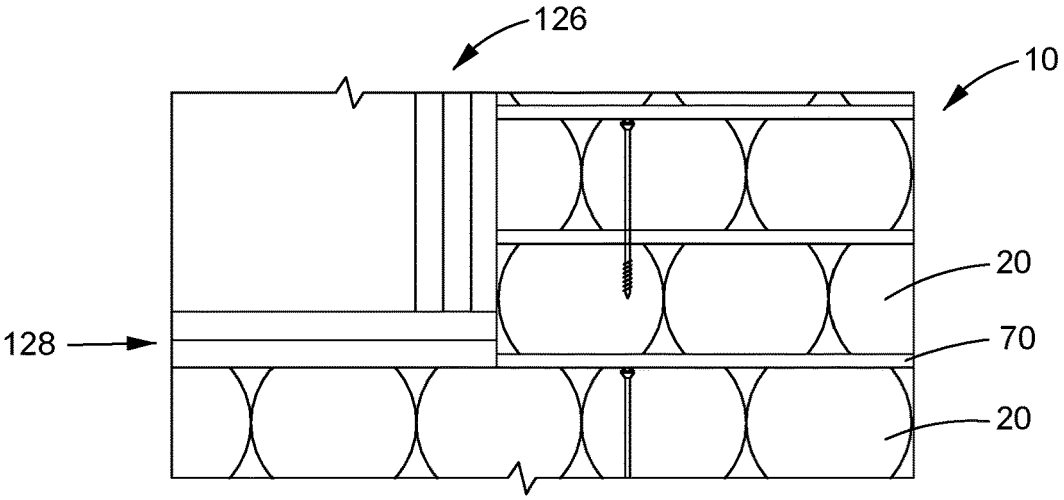
FIG. 8 is a front view of a log wall construction as a window portion of a dwelling.
Figure 9:
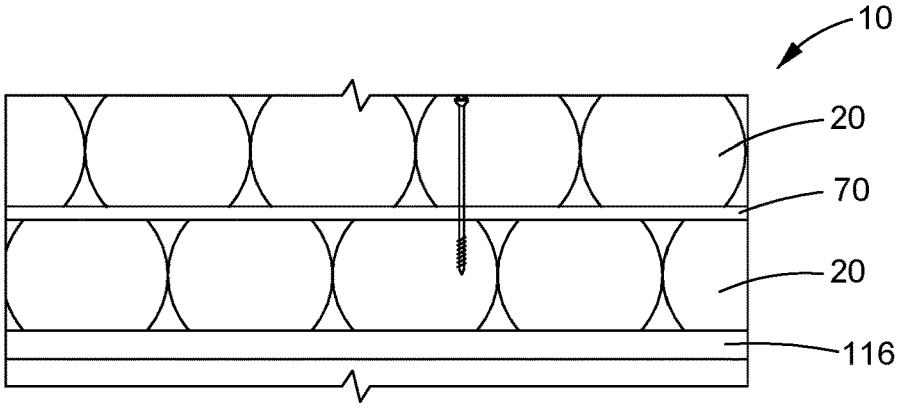
FIG. 9 is a front view of a log wall construction as a floor portion of a dwelling.
Figure 10:
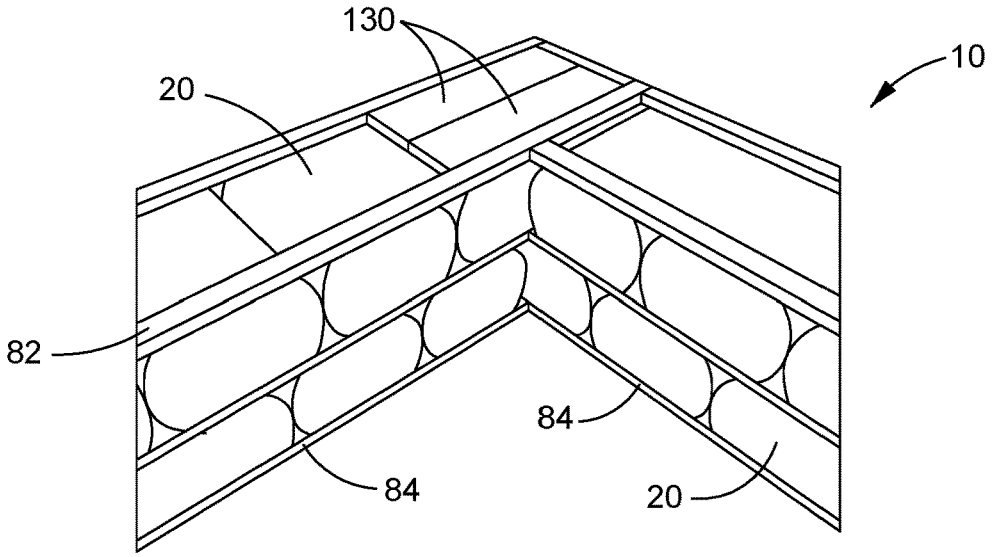
FIG. 10 is an isometric view of an interior portion of a log wall construction corner as a portion of a dwelling.
Figure 11:
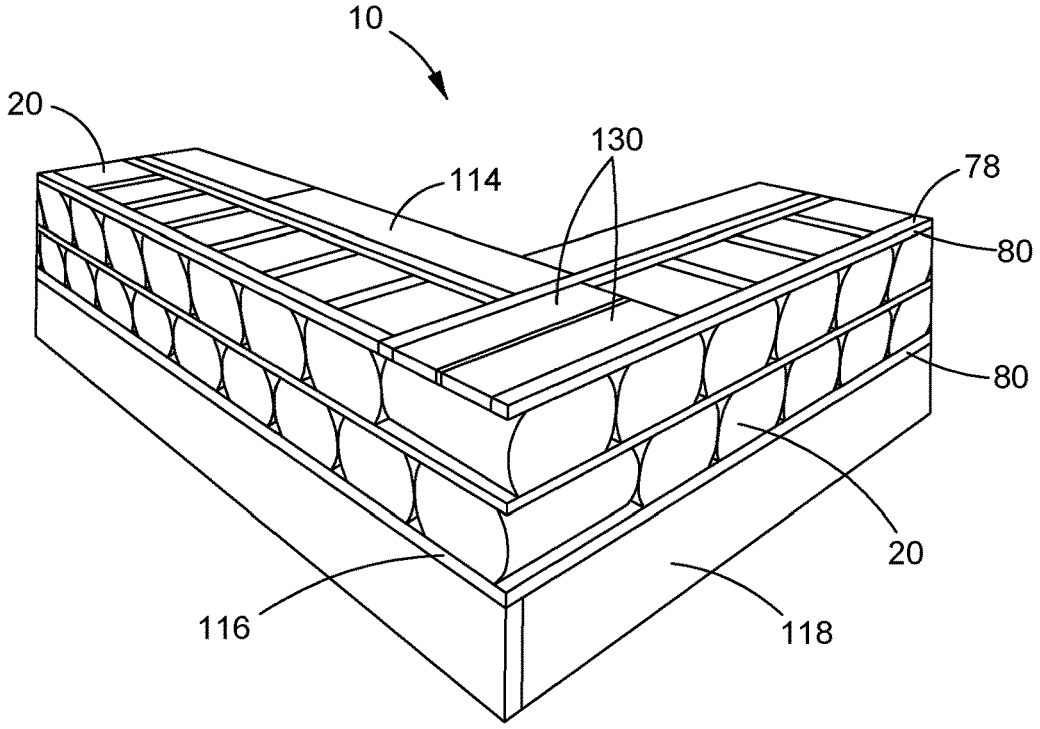
FIG. 11 is an isometric view of an exterior portion of a log wall construction corner as a portion of a dwelling.
Figure 12:
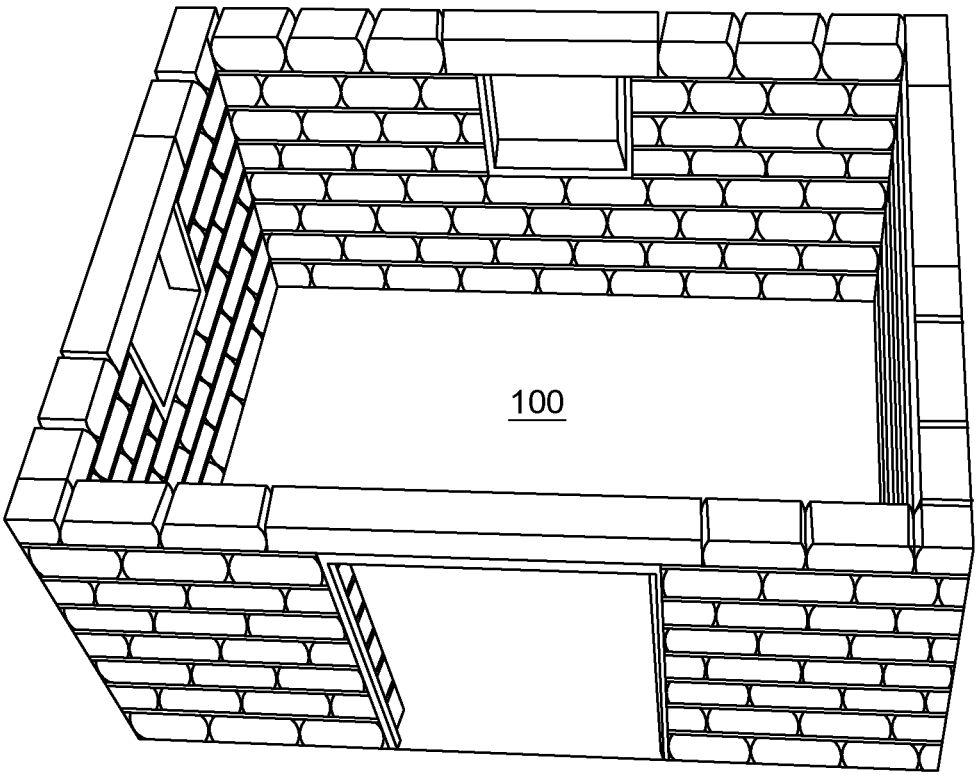
FIG. 12 is a perspective view of a log wall construction as a dwelling with a room formed by log block rows.

Considering other features of the invention, attention is directed to FIGS. 3-9 and how a wall 10 can include at least three log block rows. Further a room 100 may be formed of log block rows, as seen in FIG. 12. Also including FIGS. 10 and 11, there is seen the log wall construction of the invention as a door portion of a dwelling, a window portion of a dwelling and a floor portion of a dwelling. All this helps show how the invention can be tied into conventional structures of a dwelling as would be known to one of ordinary skill in the art of building construction in conjunction with the teaching here. For example, in the Figures and here focusing on FIGS. 5 and 6, generally starting at the roof and work our way down to the ground, there is a roof 110, tied to a top plate 112 and all this tied to wall construction 10, which sits on base plate 116 adjacent to the subfloor 114, over floor framing 120 and bounded by rim board 118. Next is foundation 122. Referring specifically to FIGS. 7 and 8 for their door and window perspective, there is seen header 124, which may be a double header like the top plate and/or other plates, over the cripples 126 (which also may be multiple layers), and both over the sill plate 128.

Figure 13A:
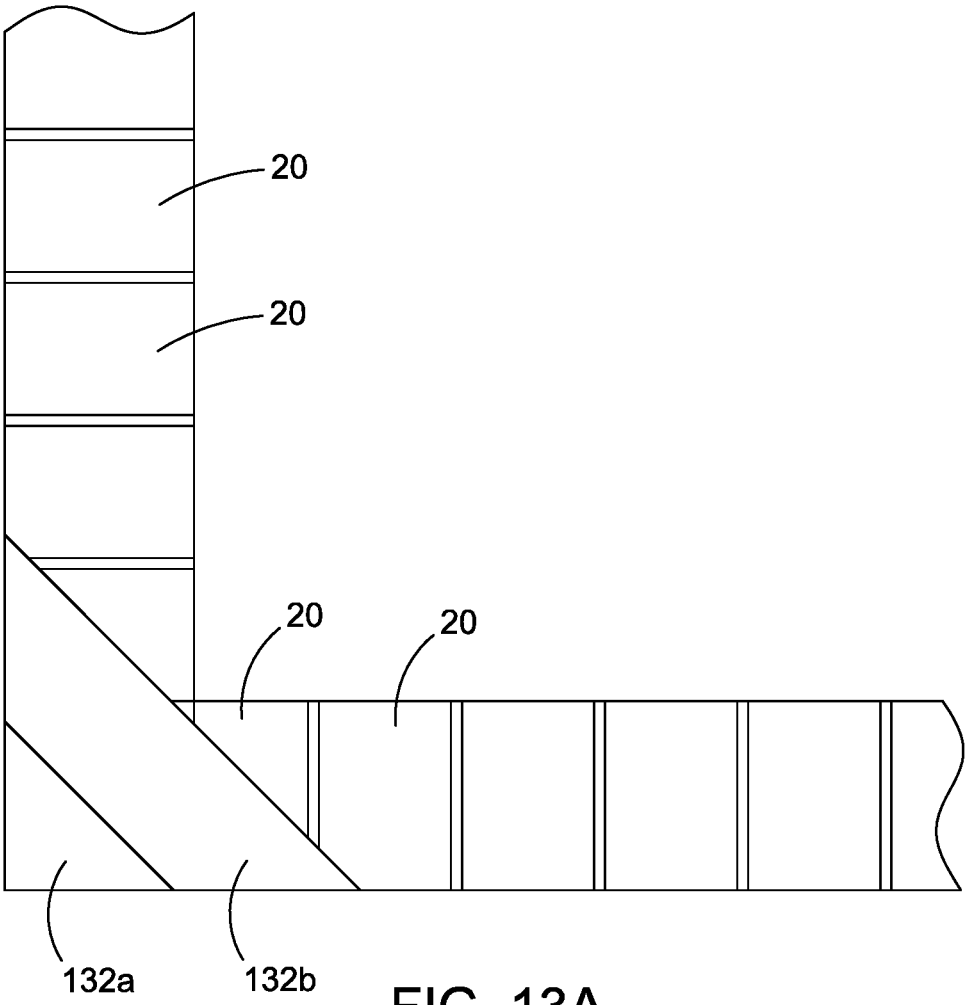
FIG. 13A is a top view of a log block row for an alternate log wall construction for a corner portion of a dwelling.
Figure 13B:
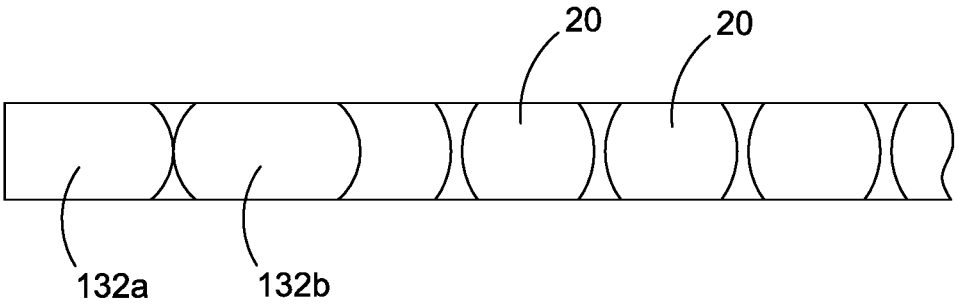
FIG. 13B is a side view of the alternate log wall construction for a corner portion of a dwelling seen in FIG. 13A.
Figure 14A:
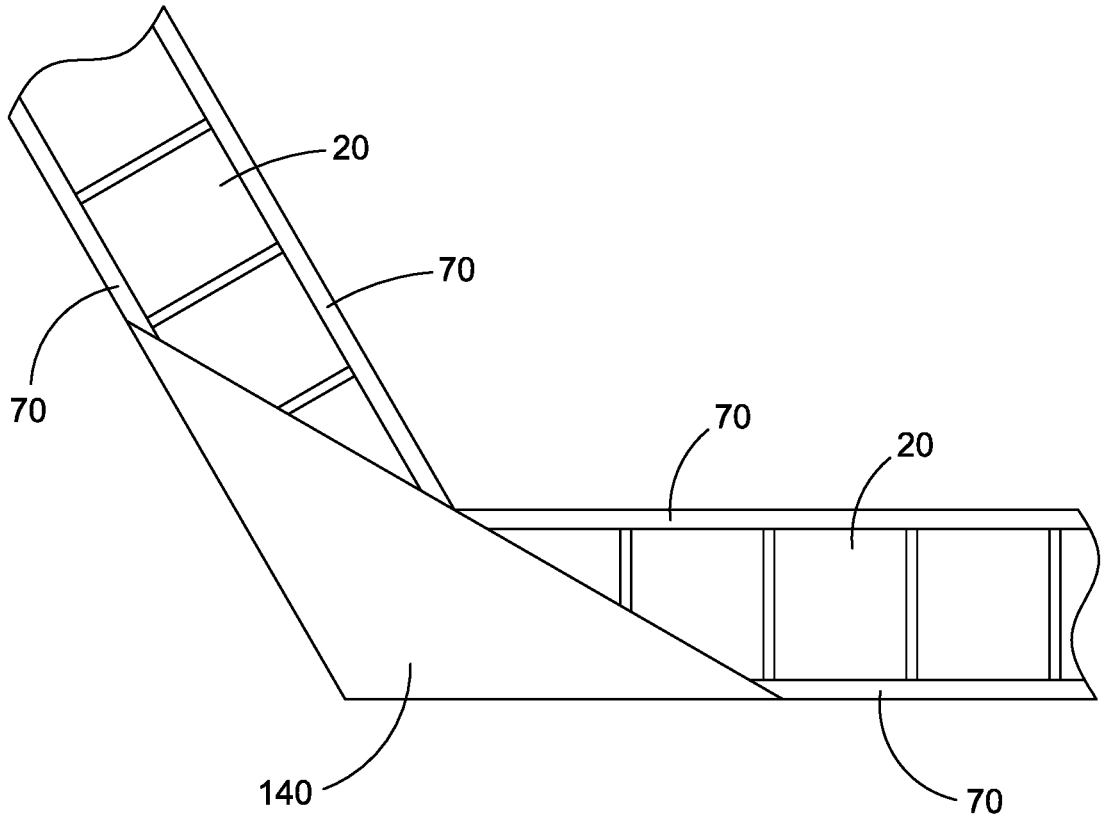
FIG. 14A is a top view of a log block row for an alternate log wall construction for a corner portion of a dwelling; and, FIG. 14B is a side view of the alternate log wall construction for a corner portion of a dwelling seen in FIG. 14A.
Figure 14B:
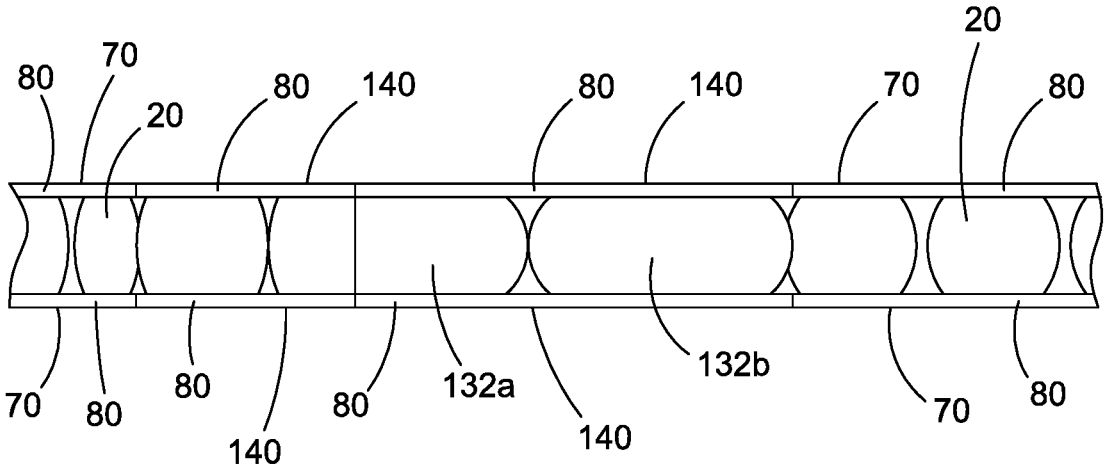

Referring to FIGS. 10, 11, 13A, 13B, 14A and 14B, some corner construction options are seen. The corners could have interlocking blocks 130 formed to each other as in FIGS. 10 and 11. Alternately, from a structural standpoint use of the stringers with an interlocking pattern of 45 degree angle cut log blocks 132*a* and 132*b* (and could be additional 45 degree cut blocks if needed) as seen in FIGS. 13A and 13B would add another way to ensure a stable log block row, and thereby whole wall stability, if desired. Alternatively, and referring to FIGS. 14A and 14B that show a sample 60 degree angle corner, the corner can be made structurally sound for other than 90 degree corners with the use of plywood as the stringer 140 for the corner at the substantially full to full width of the wall thickness (and could be used for 90 degrees too, if desired).

Each and every document cited in this present application, including any cross referenced or related patent or application, is incorporated in this present application in its entirety by this reference, unless expressly excluded or otherwise limited. The citation of any document is not an admission that it is prior art with respect to any embodiment disclosed in this present application or that it alone, or in any combination with any other reference or references, teaches, suggests, or discloses any such embodiment. Further, to the extent that any meaning or definition of a term in this present application conflicts with any meaning or definition of the same term in a document incorporated by reference, the meaning or definition assigned to that term in this present application governs.

The present invention includes the description, examples, embodiments, and drawings disclosed; but it is not limited to such description, examples, embodiments, or drawings. As briefly described above, the reader should assume that features of one disclosed embodiment can also be applied to all other disclosed embodiments, unless expressly indicated to the contrary. Unless expressly indicated to the contrary, the numerical parameters set forth in the present application are approximations that can vary depending on the desired properties sought to be obtained by a person of ordinary skill in the art without undue experimentation using the teachings disclosed in the present application. Modifications and other embodiments will be apparent to a person of ordinary skill in the packaging arts, and all such modifications and other embodiments are intended and deemed to be within the scope of the present invention.

What is claimed is:

1. A log wall construction comprising:

a dwelling formed with a plurality of log blocks, each of the plurality of log blocks having a substantially same height-dimension;

the plurality of log blocks laid next to each other to form a log block row having a log block row length, each log block having a top flat surface, a bottom flat surface, a front flat surface, a back flat surface, a right curved vertically sloped convex surface and a left curved vertically sloped convex surface, and where log blocks next to each other have at least one pair of adjacent curved vertically sloped convex surfaces for each pair of log blocks next to each other;

a second log block row of the plurality of log blocks each having a second substantially same height-dimension and laid next to each other to form the second log block row having a second log block row length and being located on top of the log block row; and, a stringer located between the log block row and the second log block row and separating the flat top surface of each log block in the log block row from the flat bottom surface of each log block in the second log block row wherever log blocks of the log block row are adjacent to log blocks of the second log block row, the stringer extending substantially an entire distance that is equivalent to both the log block row length and the second log block row length.

2. The log wall construction of claim 1, wherein at least some of the log blocks are a full-sized log block.

3. The log wall construction of claim 1, wherein at least some of the log blocks are a half-sized log block.

4. The log wall construction of claim 3, wherein the half-sized log block has a width-dimension that is at least two times as long as a height-dimension.

5. The log wall construction of claim 1, wherein at least two log blocks next to each other have at least a portion of each log block touching each other at adjacent curved vertically sloped convex surfaces.

6. The log wall construction of claim 5, wherein substantially all log blocks next to each other have at least a portion of each log block touching each other at adjacent curved vertically sloped convex surfaces.

7. The log wall construction of claim 1, wherein the stringer has a front runner with a front stringer edge that is adjacent to the front flat surface of the log blocks and the stringer has a back runner with a back stringer edge that is adjacent to the back flat surface of the log blocks.

8. The log wall construction of claim 7, wherein the front runner is separated from the back runner.

9. The log wall construction of claim 8, wherein the front runner is distinct from and completely separated from the back runner.

10. The log wall construction of claim 7, wherein the stringer has a width-dimension that is at least two times as long as a height-dimension.

11. The log wall construction of claim 10, wherein the height-dimension of the stringer is between about 0.5 inches and about 1.5 inches.

12. The log wall construction of claim 10, wherein the width-dimension of the stringer is between about 1 inch and about 3 inches.

13. The log wall construction of claim 1, wherein a mechanical fastener secures the log block row to the second log block row.

14. The log wall construction of claim 13, wherein the mechanical fastener extends in and between at least a portion of the log block row and at least a portion of the second log block row.

15. The log wall construction of claim 1, comprising at least three log block rows.

16. The log wall construction of claim 15, comprising a room formed of log block rows.

17. A log wall construction comprising:

a dwelling formed with a plurality of log blocks, each of the plurality of log blocks having a substantially same height-dimension;

the plurality of log blocks laid next to each other to form a log block row having a log block row length, each log block having a top flat surface, a bottom flat surface, a front flat surface, a back flat surface, a right curved vertically sloped convex surface and a left curved vertically sloped convex surface, and where log blocks next to each other have at least one pair of adjacent curved vertically sloped convex surfaces for each pair of log blocks next to each other;

a second log block row of the plurality of log blocks each having a second substantially same height-dimension and laid next to each other to form the second log block row having a second log block row length and being located on top of the first log block row;

a stringer located between the log block row and the second log block row and separating the flat top surface of each log block in the log block row from the flat bottom surface of each log block in the second log block row wherever log blocks of the log block row are adjacent to log blocks of the second log block row, the stringer extending substantially an entire distance that is equivalent to both the log block row length and the second log block row length, and the stringer has a front runner with a front stringer edge that is adjacent to the front surface of the log blocks and the stringer has a back runner with a back stringer edge that is adjacent to the back surface of the log blocks; and wherein at least two log blocks next to each other have at least a portion of each log block touching each other at adjacent curved vertically sloped convex surfaces and each log block row has a same sized log block in that log block row.

18. The log wall construction of claim 17, wherein the front runner is distinct from and completely separated from the back runner.

19. The log wall construction of claim 17, wherein a log wall has substantially only the same sized log blocks in each log block row of the log wall.

20. The log wall construction of claim 17, wherein substantially all log blocks next to each other have at least a portion of each log block touching each other at adjacent curved vertically sloped convex surfaces.

* * * * *